US007319408B2

(12) United States Patent
Temple

(10) Patent No.: US 7,319,408 B2
(45) Date of Patent: Jan. 15, 2008

(54) LED NET DISPLAY

(75) Inventor: John W. Temple, Ocean Park, WA (US)

(73) Assignee: Advance Display Technologies, Inc., Englewood, CO (US)

( * ) Notice: Subject to any disclaimer, the term of this patent is extended or adjusted under 35 U.S.C. 154(b) by 0 days.

(21) Appl. No.: 11/207,354

(22) Filed: Aug. 18, 2005

(65) Prior Publication Data

US 2006/0039142 A1 Feb. 23, 2006

Related U.S. Application Data

(60) Provisional application No. 60/603,805, filed on Aug. 23, 2004.

(51) Int. Cl.
*G09F 9/33* (2006.01)

(52) U.S. Cl. ..... 340/815.45; 345/39; 345/55

(58) Field of Classification Search ..... 340/815.45
See application file for complete search history.

(56) References Cited

U.S. PATENT DOCUMENTS

| | | | | |
|---|---|---|---|---|
| 4,782,336 | A | 11/1988 | Bailey | |
| 5,532,711 | A | 7/1996 | Harris | |
| 5,900,850 | A | 5/1999 | Bailey et al. | |
| 6,737,983 | B1 | 5/2004 | Temple | |
| 2003/0117347 | A1 * | 6/2003 | Hunter et al. | 345/76 |
| 2003/0117348 | A1 * | 6/2003 | Knapp et al. | 345/76 |
| 2005/0237273 | A1 * | 10/2005 | Ozawa et al. | 345/46 |
| 2006/0050032 | A1 * | 3/2006 | Gunner et al. | 345/82 |

* cited by examiner

*Primary Examiner*—George Bugg
(74) *Attorney, Agent, or Firm*—McAndrews, Held & Malloy, Ltd.

(57) ABSTRACT

An outdoor display includes a net formed of intersecting cables and a number of pixel display units disposed on the net at the intersection of a pair of cables. Each pixel unit includes a number of different colored LEDs. The LEDs of the pixel units forming the display are selectively activated to form a still image or moving video images. The net display can be attached to, supported by or between existing structures.

10 Claims, 5 Drawing Sheets

LED NET DISPLAY

CROSS-REFERENCE TO RELATED APPLICATIONS

The present application claims the priority of provisional patent application Ser. No. 60/603,805 filed Aug. 23, 2004. That application is hereby incorporated herein by reference.

STATEMENT REGARDING FEDERALLY SPONSORED RESEARCH OR DEVELOPMENT

N/A

TECHNICAL FIELD

The present invention is directed to an outdoor display and more particularly to a display including a net supporting spaced, lighted pixel units.

BACKGROUND OF THE INVENTION

Billboard signs and the like are well known and typically include a support to which is adhered a printed advertisement. Billboard signs are typically very large, on the order of 14 feet by 48 feet, although boards of 10×20 feet, 12×16 feet, 18×24 feet and 40×60 feet are used as well. To change the message on a billboard, the old printed advertisement is removed from the support and replaced by a new printed advertisement. Alternatively, the new printed advertisement is adhered directly over the old advertisement.

Outdoor signs have also been formed using light emitting diode (LED) displays. One such known display is disclosed in U.S. Pat. No. 6,737,983. This patent shows an outdoor display that includes a support for a printed advertisement to convey a first message. The support as well as the printed advertisement adhered thereto includes a matrix of spaced apertures, wherein a light emitting diode cluster is supported in each of the spaced apertures to form an LED matrix. During ambient light conditions, the printed advertisement conveys its message to passersby and if desired, the LED matrix is operated to enhance the printed image such as by providing a "twinkling" background or other enhancements to the primary, printed message. When ambient light is low, for example at dusk to dawn, the LEDs of the display are energized to produce a second, different image. Since the LEDs during low ambient light conditions need not overcome strong light, the LEDs can be spaced at a greater distance and contain fewer color LEDs than would be necessary for daylight operation of an outdoor LED display. Although this type of display provides a reduced cost, outdoor LED display, it cannot be used where wind load is high. Moreover, like conventional billboard signs or displays, if mounted on a building, the display blocks windows.

BRIEF SUMMARY OF THE INVENTION

In accordance with the present invention, the disadvantages of prior LED displays for outdoor use have been overcome. The outdoor display of the present invention includes a net supporting spaced, lighted pixel units that are controlled to depict a still image or moving, video images. The net can be supported on or between any existing structure. Because of its flexible nature, the net display may be supported on curved or irregular surfaces as well as flat surfaces. The net display of the present invention can overlie a printed image or it can be used alone. When supported on a billboard, for example, overlying an existing printed image, during high ambient light conditions the net display can be turned off so that the printed image is visible. Alternatively, selective pixel units of the display can be lit to enhance the printed image. During low ambient light conditions, the LED display can be actuated to create an entirely new image, blocking the underlying printed image. The display of the present invention is capable of displaying full motion video, web pages, stills, graphics and text-oriented messages.

The display of the present invention includes a net formed of a first set of generally parallel cables and a second set of cables, the cables in the second set intersecting cables in the first set to form the net. A number of spaced pixel units are mounted on the net where each pixel unit has a number of lights in a number of colors mounted on a support. In a preferred embodiment, each of the lights is a light emitting diode.

The lighted net display of the present invention can be used with or without a printed background message. It can be draped over windows of a building without blocking light. It can further be suspended between two supports, structures or buildings since the net design reduces the wind load factor by 75-90%. Moreover, the portable nature of the lighted net display allows it to be deployed in a temporary use situation. For example, the net may be transported in a role or the like and installed by merely unrolling the net and attaching it to a desired structure. Further, because the net display of the present invention is a fraction of the weight of existing displays, it can be used in situations where other lighted displays having cabinets, etc. cannot be used.

These and other advantages and novel features of the present invention, as well as details of an illustrated embodiment thereof, will be more fully understood from the following description and drawings.

DETAILED DESCRIPTION OF THE INVENTION

Figure 1:
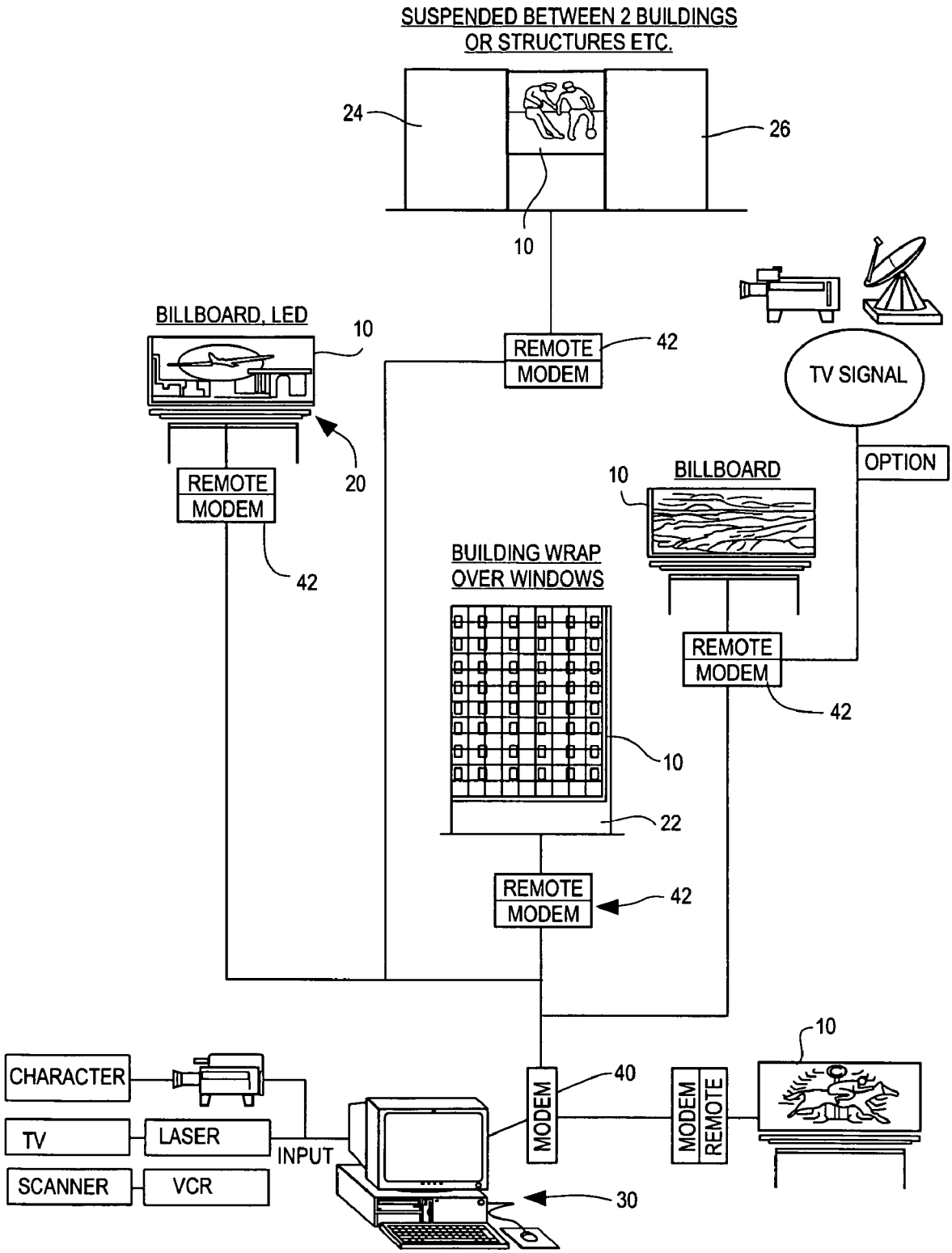
FIG. 1 is a block diagram illustrating a network of LED net displays in accordance with the present invention that are remotely controlled by a host computer.

A display 10 in accordance with the present invention, as depicted in FIGS. 1-4 includes a net 12 formed of intersecting cables, 14 and 16 wherein the net supports a number of spaced pixel units 18. Each pixel unit 18 includes a number of different colored lights that can be actuated alone or in different combinations to change the color of the pixel formed by a given unit 18. In a preferred embodiment, the lights are light emitting diodes (LEDs) where each pixel unit includes a cluster of at least one red, one blue and one green LED. The pixel units 18 are preferably mounted on the net 12 at or adjacent the intersection of two cables 14 and 16.

The spacing of the pixel units 18 is preferably uniform throughout the net display with a spacing between adjacent pixel units on the order of 1.5 to 12 inches. In the embodiments shown, the spacing between adjacent pixel units is on the order of 4 inches.

As illustrated in FIG. 1, the net display 10 may overlie a printed billboard sign 20. Because of the spacing of the pixel units and the open configuration of the net, the printed advertisement on the billboard is visible during high ambient light conditions, i.e. during daylight hours. During high ambient light conditions, various pixel units 18 of the display 10 can be lit to enhance the printed advertisement. During low ambient light conditions, for example dusk to dawn, the pixel units 18 can be selectively actuated, i.e. lit, blocking a view of the underlying printed advertisement and to provide a different image formed by the lit LEDs of the pixel units. The net display 10 can be used with or without an underlying graphic, such as a printed billboard sign. For example, the net 12 can be supported on the walls of a building 22. Because of the openness of the net 12 supporting the pixel units 18 and the spacing of the pixel units 18, the windows of the building are not blocked by the display 10. Moreover, because of the flexible nature of the net 12, supporting the pixel units 18, the display 10 may be draped over surfaces that are not flat, i.e. curved surfaces or irregular surfaces. Moreover, as shown in FIG. 1, the display 10 may be suspended between two buildings 24 and 26. Again, because of the open nature of the net 12, the display 10 has a wind load factor that is reduced by 75% to 90% as compared to a solid display. As such, the display 10 of the present invention can be utilized in areas where the wind load factor would prevent a solid LED display from being used.

As shown in FIG. 1, a number of net displays 10 can be controlled remotely from a single host computer 30 via a modem 40 associated with the host computer 30 and a modem 42 associated with each display 10. It is noted, that the host computer 30 can also communicate with a respective display 10 by transmitting digital image and control signals thereto via wireless communication where the modems are replaced by transceiver units. Graphics, video or still images can be input from various sources such as a digital camera, TV, scanner, etc. to the host computer and transmitted by the host computer to a particular display 10 to change the image depicted thereon or to present a live, full motion video.

Figure 2:
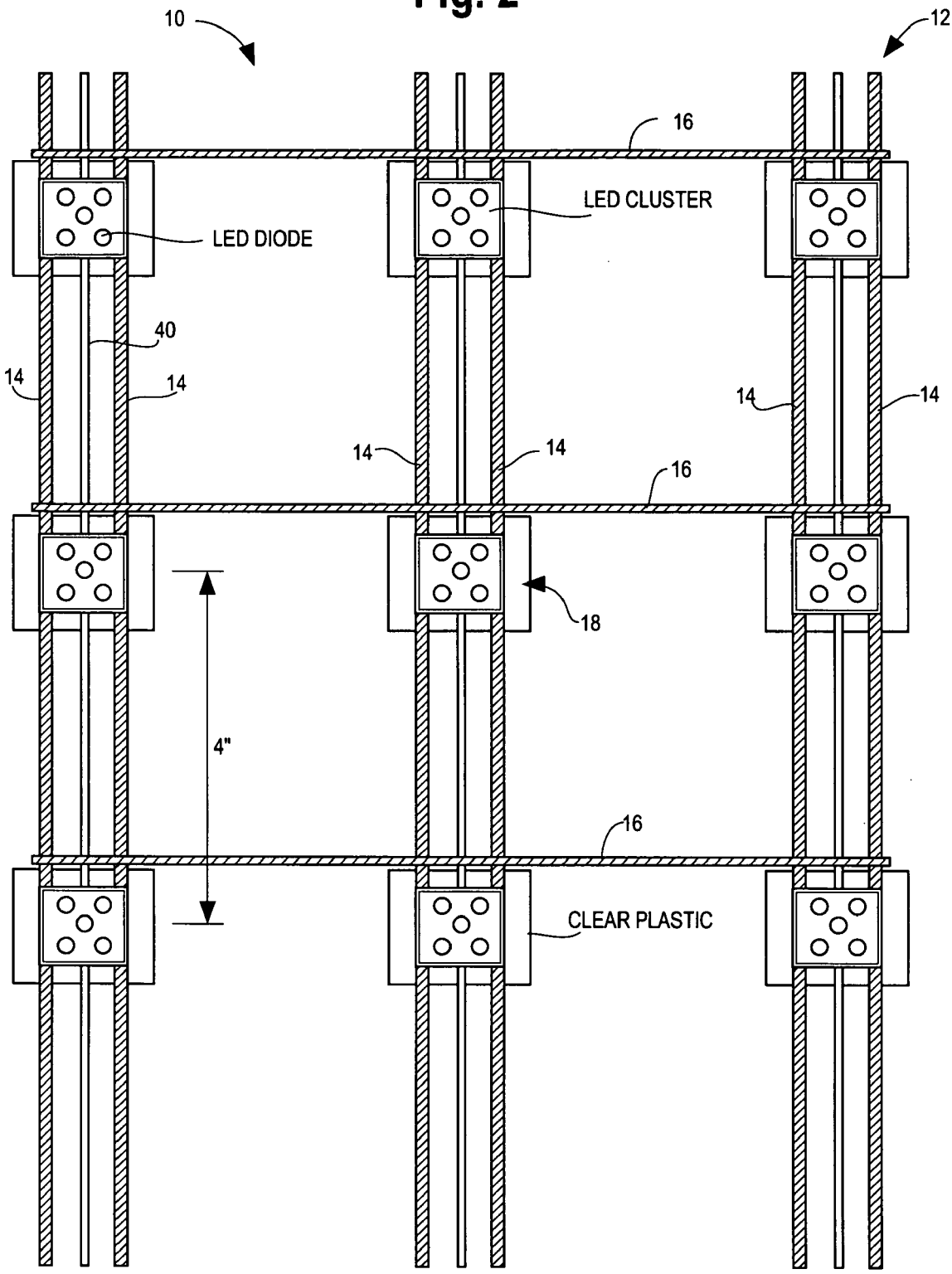
FIG. 2 is a partial, front view of an LED net display in accordance with one embodiment of the present invention.

The net 12 can be formed by intersecting cables in a number of different configurations. As shown in FIG. 2, a number of parallel cables 14 form a first set of cables extending in a first direction. These cables intersect the cables 16 of a second set such that the cables of the first set are generally perpendicular to the cables of the second set. In this embodiment, each of the pixel units 18 is supported by a pair of cables 14 in the first set, at or adjacent to the point at which a cable 16 intersects the pair of cables 14. The display 10 also includes a power line 40 and an associated data control line 42 that extend generally parallel to each of the cables 14 so as to provide power, data and control signals to each of the pixel units 18. Each of the cables 14, 16 can be formed of a steel cable, an aluminum cable or other type of metal cable. Alternatively, the cables 14, 16 may be formed of a fiber line such as Kevlar or Spectra. The power and data/control lines can be entwined or encased with a cable 14 in a manner such that the cable bears the load formed by the components of the display 10. Alternatively, the power and data/control lines can be separated from the cables forming the net.

Figure 3:
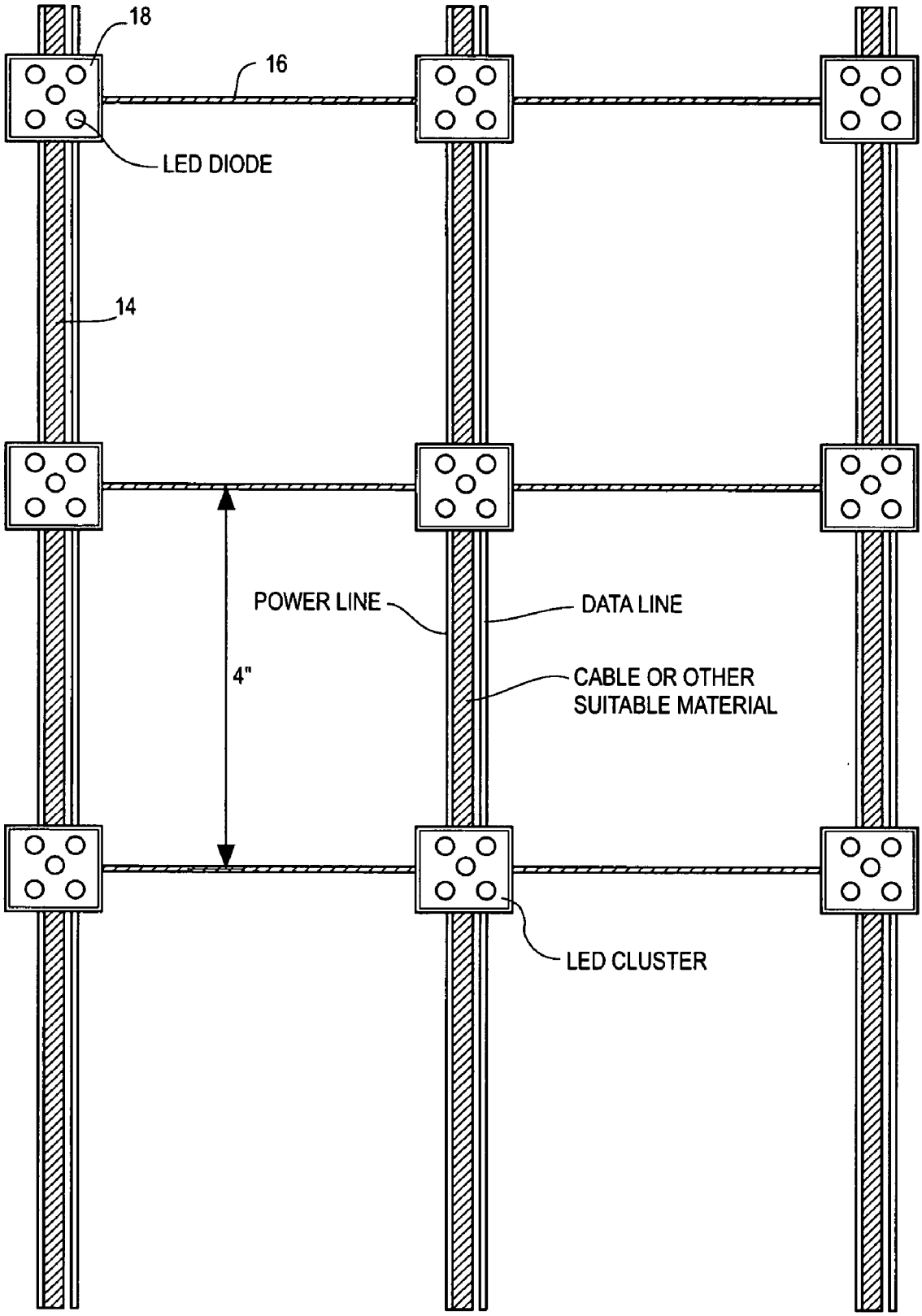
FIG. 3 is a partial, front view of an LED net display in accordance with an alternative embodiment of the present invention.
Figure 4:
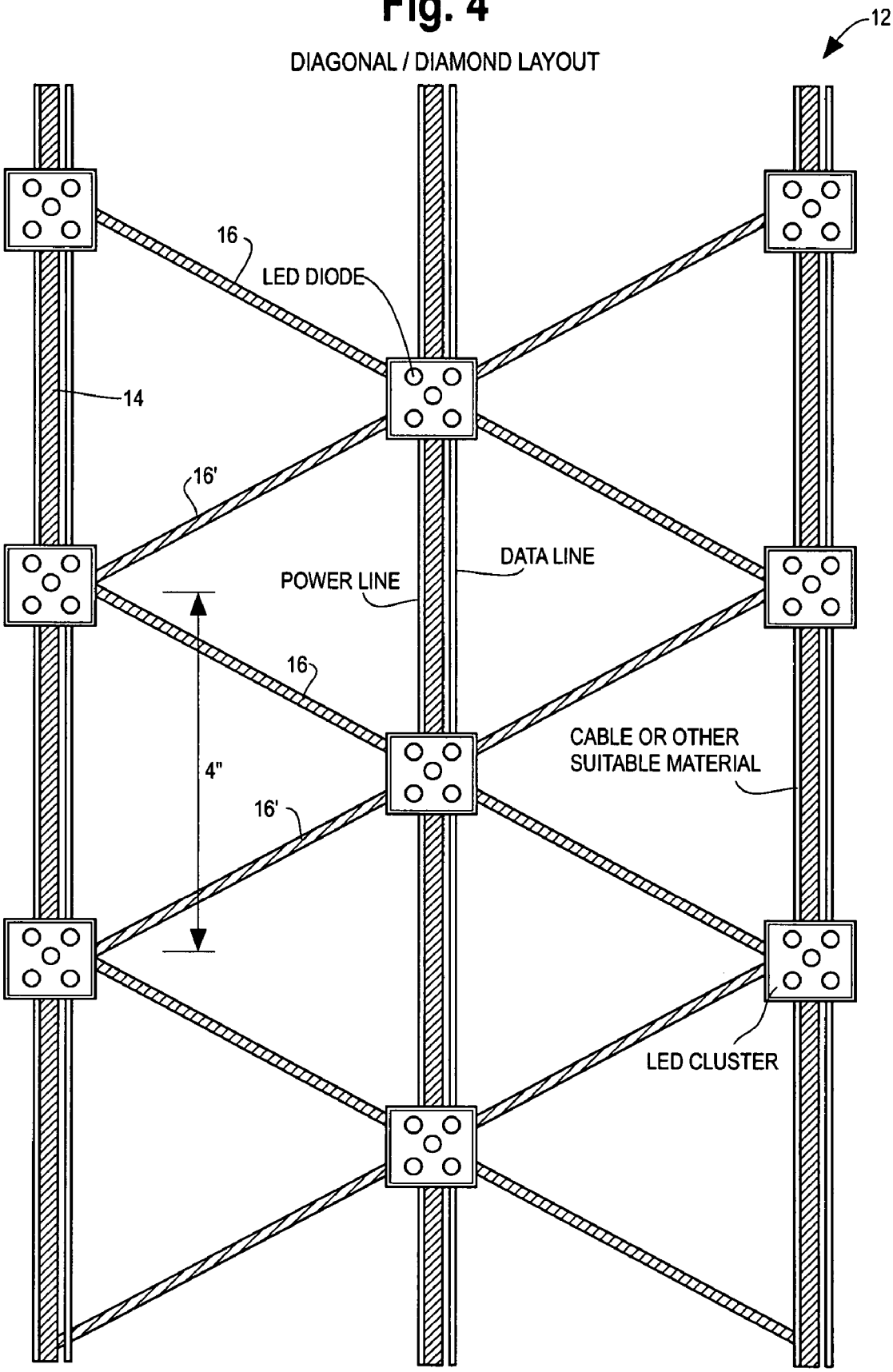
FIG. 4 is a partial, front view of an LED net display in accordance with a further alternative embodiment of the present invention.

In an alternative net embodiment, depicted in FIG. 3, each of the pixel units 18 is supported on the net at the intersection of one cable 14 and one cable 16. In this embodiment, the power and data/control lines are adjacent to, entwined or encased with a cable 14. In a further embodiment of the net 12 as depicted in FIG. 4, the net is formed of a first set of generally parallel cables 14 and a second set of cables that intersect with the first set of cables 14. The second set of cables includes a first group of parallel cables 16 and a second group of parallel cables 16' wherein the first group of cables 16 and the second group of cables 16' intersect each other as well as intersecting the cables 14 of the first set so as to provide a diagonal or diamond layout for the net 12. In this embodiment, the pixel units 18 are mounted on the net at the cable intersection points.

Figure 5:
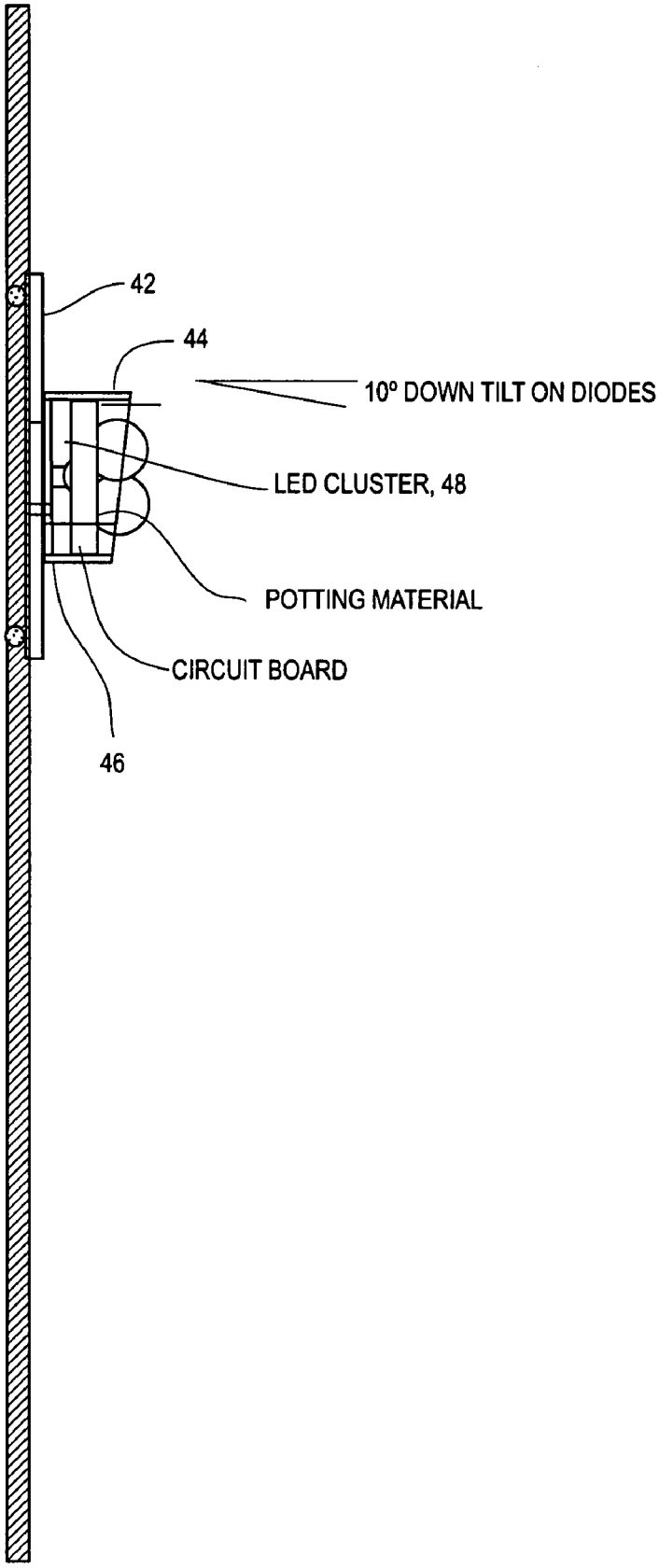
FIG. 5 is a cross-sectional side view of a pixel unit attached to a cable of the net.

As shown in FIG. 5, each of the pixel units includes a support or base 42 that can be fastened to one or more cables of the net 12. An LED housing module 44 is mounted on the support 42 wherein the LED module 44 includes an LED cluster 48 formed of at least one red LED, one blue LED and one green LED. The module 44 also includes a circuit board 46 that includes drivers for each of the LEDs wherein the circuit board 46 is coupled to the power and data/control lines of the net. Potting material in the LED module 44 preferably seals the portion of the module containing the circuit board 46 from the environment. The LEDs are preferably positioned in the module 44 such that they are tilted downward by an approximate 10° angle such that the plane of the LEDs is at an angle with respect to the support 42.

Because the net 12 provides a flexible support for the pixel units 18, the display 10 can be rolled upon a drum or like for easy transportation. As such, the display 10 in accordance with the present invention is portable. It is easily installed by merely unrolling the net 12 from the drum and draping the net 12 over or attaching it to an existing structure. Moreover, the weight of the net display 10 of the present invention is substantially less than the weight of a standard lighted display. As such, it can be used and supported by structures having load support limitations.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. A display for use outdoors comprising:

a net formed of a first set of generally parallel support cables and a second set of support cables, the cables in the second set intersecting cables in the first set; and a plurality of spaced pixel units mounted on the net, each pixel unit having a plurality of light emitting diodes in a plurality of colors mounted on a support, wherein the support cables provide structural support for the pixel units.

2. A display as recited in claim 1 wherein each pixel unit includes at least one red light emitting diode, one green light emitting diode and one blue light emitting diode.

3. A display as recited in claim 1 wherein the net includes a power line and a control line, each pixel unit being coupled to a power line and a control line.

4. A display as recited in claim 1 wherein the cables in the second set are generally parallel to each other.

5. A display as recited in claim 4 wherein the cables of the second set are generally perpendicular to the cables of the first set.

6. A display comprising:

a net formed of a first set of generally parallel support cables and a second set of support cables, the cables in the second set intersecting cables in the first set; and a plurality of spaced pixel units mounted on the net, each pixel unit having a plurality of light emitting diodes in a plurality of colors mounted on a support wherein the support cables in the second set include a first group of generally parallel cables and a second group of generally parallel cables wherein the first group of cables intersects the second group of cables and the first and second group of cables intersect the first set of cables and wherein the support cables provide structural support for the pixel units.

7. A display comprising:

a net formed of a first set of generally parallel support cables and a second set of support cables, the cables in the second set intersecting cables in the first set; and a plurality of spaced pixel units mounted on the net, each pixel unit having a plurality of light emitting diodes in a plurality of colors mounted on a support, wherein the support cables provide structural support for the pixel units and wherein adjacent pixel units are spaced apart on the net by 1.5 to 12 inches.

8. A display as recited in claim 1 wherein the pixel units are uniformly spaced on the net.

9. A display comprising:

a net formed of a first set of generally parallel support cables and a second set of support cables, the cables in the second set intersecting cables in the first set; and a plurality of spaced pixel units mounted on the net, each pixel unit having a plurality of lights in a plurality of colors mounted on a support, each pixel unit being mounted on the net at an intersection of a cable from the first set and a cable from the second set, wherein the support cables provide structural support for the pixel units.

10. A display as recited in claim 9 wherein each of the lights is a light emitting diode.

* * * * *